United States Patent [19]

Kronogard

[11] 4,082,477

[45] Apr. 4, 1978

[54] COMPRESSOR HAVING TWO OR MORE STAGES

[75] Inventor: Sven-Olof Kronogard, Lomma, Sweden

[73] Assignee: United Turbine AB & Co., Sweden

[21] Appl. No.: 636,653

[22] Filed: Dec. 1, 1975

Related U.S. Application Data

[62] Division of Ser. No. 521,540, Nov. 6, 1974, Pat. No. 3,941,499.

[51] Int. Cl.[2] ..... F01D 1/08; F01D 13/00

[52] U.S. Cl. ..... 415/120; 415/143; 415/199.1

[58] Field of Search ..... 415/120, 198, DIG. 1, 415/143

[56] References Cited

U.S. PATENT DOCUMENTS

| | | | |
|---|---|---|---|
| 1,213,889 | 1/1917 | Lawaczeck | 415/198 |
| 1,988,163 | 1/1935 | Church | 415/198 |
| 2,265,806 | 12/1941 | Goldsmith | 415/120 |
| 2,985,108 | 5/1961 | Stoner et al. | 415/120 |
| 3,305,165 | 2/1967 | Gregory | 415/120 |
| 3,846,038 | 11/1974 | Carriere et al. | 415/DIG. 1 |

FOREIGN PATENT DOCUMENTS

| | | | |
|---|---|---|---|
| 1,373,803 | 10/1964 | France | 415/198 |
| 494,608 | 9/1951 | Italy | 415/143 |
| 4,511,921 | 1970 | Japan | 415/120 |
| 290,415 | 8/1953 | Switzerland | 415/143 |
| 242,855 | 11/1925 | United Kingdom | 415/198 |
| 619,722 | 3/1949 | United Kingdom | 415/DIG. 1 |

*Primary Examiner*—William L. Freeh
*Attorney, Agent, or Firm*—Holman & Stern

[57] ABSTRACT

In order to raise the degree of compression without unduly increasing the dimensions a compressor having at least two stages includes a first centripetal stage and a last centrifugal stage mounted upon the same shaft. The diameter at the centripetal stage inlet does not exceed the diameter at the outlet of the centrifugal stage and the air flows radially inwards in the first stage, and radially outwards in the last stage.

4 Claims, 4 Drawing Figures

COMPRESSOR HAVING TWO OR MORE STAGES

This is a divisional of application Ser. No. 521,540, filed Nov. 6, 1974 now U.S. Pat. No. 3,941,499.

BACKGROUND OF THE INVENTION

A centrifugal compressor is a simple and reliable machine element when designed as a single stage unit, and is extensively used in gas turbine power plants, turbocharger units and the like, where a compression of 4:1 a 6:1 is satisfactory. In order to obtain a higher degree of compression two or more centrifugal stages will have to be arranged in series, but this means a complication as well as an undesirable increase of weight and requirement for space. The latter consequence is mainly caused by return bends between the individual stages.

It has also been proposed to use one or more axial stages ahead of the centrifugal stage, which may be attractive i.a. with respect to the reduction of costs and weight. In order to obtain any noticeable increase of the pressure with a few axial stages it will however be necessary to design these with a mean diameter which is considerably greater than the outer diameter of the inlet of the compressor. This means a high centrifugal speed in the axial stages and a radial variation of the air distribution and the Mach-number at the centrifugal stage inlet. At the same time the length of the unit will be increased due to the length of the passageway between the axial and the radial parts of the compressor being extended.

A simpler, more compact plant having a high efficiency is desirable with many installations, where a compression ratio of between 6:1 and 12:s is needed. The high compression ratio and the wide operating field of a two stage centrifugal compressor would be advantageous combined with the compactness and the high efficiency of a simple stage axial compressor preceeding a centrifugal compressor. With a wide field of operation this has hitherto been possible with complicated two stage centrifugal compressors only.

SUMMARY OF THE INVENTION

The present invention refers to a simple compressor having at least two stages, of which the first one is a centripetal stage and the last one is a centrifugal stage mounted upon the same shaft, the outlet of the centripetal stage merging into the inlet of the centrifugal stage either directly or by way of an axial intermediate stage, in such a manner that the flow will occur radially inwards in the first stage and radially outwards in the last stage, the rotor of the centripetal stage having a diameter not exceeding the diameter at the outlet of the centrifugal stage.

BRIEF DESCRIPTION OF SOME PREFERRED EMBODIMENTS

Figure 1:
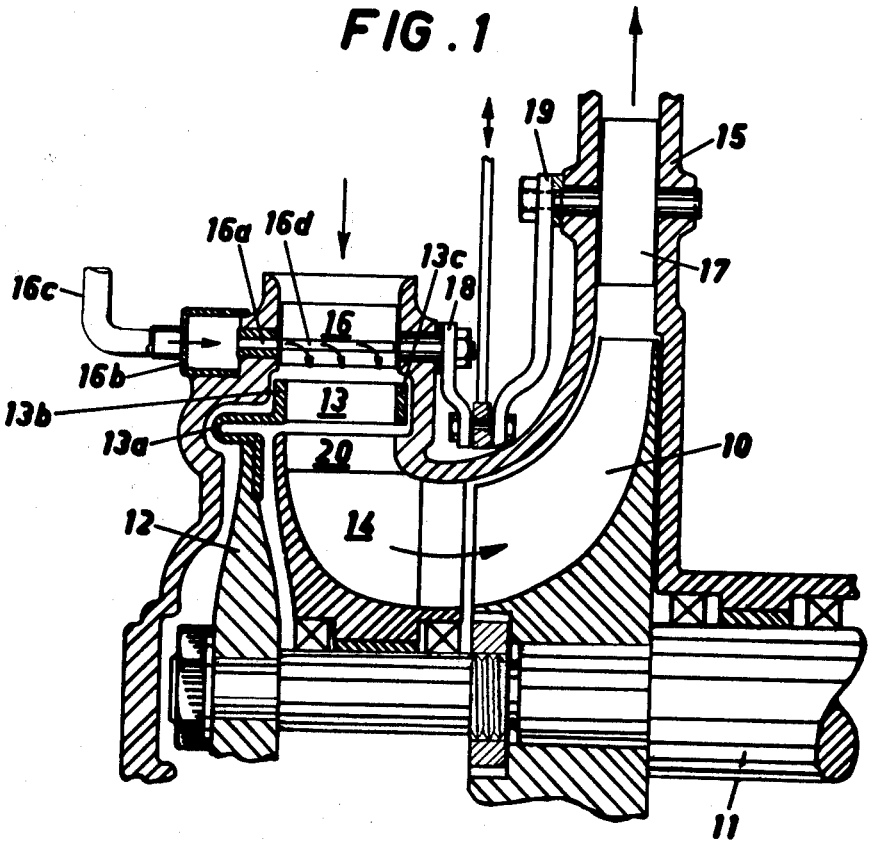
FIG. 1 is an axial section through part of a two stage compressor according to the invention

In the two stage compressor shown in FIG. 1 the last stage is a centrifugal compressor 10 of conventional disc type, i.e. having a rotor with substantially radially directed vanes open to one side of the rotor, a centrally located inlet and an outlet along the perephery of the rotor. On the same shaft 11 as this centrifugal compressor a centripetal compressor is mounted, said compressor including a rotor disc 12, which along its rim is provided with a ring of axially directed vanes 13.

The centripetal vanes, as well as their supporting annuli **13*b*, 13*c* are arranged cantileverwise with respect to the disc and are connected thereto by means of resilient members 13*a*. The vanes are designed with a very small radius ratio between the outlet and the inlet, whereby the centrifugal action will be quite unimportant, while the aerodynamic action perdominates. The outlet end 14 of the centripetal compressor is formed within the housing 15 common to both stages and includes outlet guide vanes 20. The shaft 11** is journalled within this portion of the housing. As is evident from the drawing the air will flow radially inwards in the first stage, and radially outwards in the second stage, performing a soft bend therebetween, whereby the air passage, as viewed in a cross section will similate a U.

The centripetal compressor is provided with axial, adjustable inlet guide vanes 16 and the centrifugal compressor has adjustable outlet guide vanes 17. The latter will be needed with very high compression ratios only and/or when a very wide field of operation is required. The mechanisms 18 and 19 for operating the guide vanes are interconnected and may be adjusted by a common governing member. By designing the vanes at the inlet, 16, of the centripetal compressor rotor 13, at the outlet, 20, thereof with the same profile over the full length of the pertaining vanes it will be possible to maintain ideal flow conditions during varying operating conditions, as well as to obtain the same Mach-number all along the vane, which has hitherto been impossible with known, combined centrifugal compressors.

FIG. 1 also shows an arrangement for the supply, during use, of a fluid for washing the compressor and/or for making possible a temporary boost with automotive or industrial gas turbines. The shafts to at least some of the inlet guide vanes are provided with an axial bore **16*a*. An annular channel member 16*b* is fitted to the compressor housing and is connected to a supply conduit 16*c*. The vanes are slotted at 16*d*** so the fluid, whenever deired, may be sprayed into the stream of air.

Figure 2:
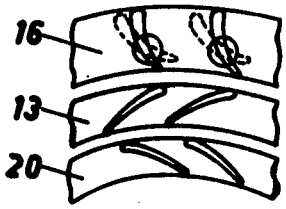
FIG. 2 shows a portion through the vane system of the centripetal compressor.

FIG. 2 shows a section through a portion of the vane system of the centripetal compressor, illustrating two different positions for the adjustable inlet vanes 16.

Depending upon the position of these vanes the centripetal compressor will deliver air of different pressures, and it may even be possible to make the compressor act as a turbine, which means a reduction of the totally delivered air volume, as well as of compression ratio and of the power required for driving the unit.

The external diameter of the centripetal compressor is selected so as to be noticeably smaller than the external diameter of the centrifugal compressor, preferably less than the mean value between the outlet diameter and the outer inlet diameter.

Figure 3:
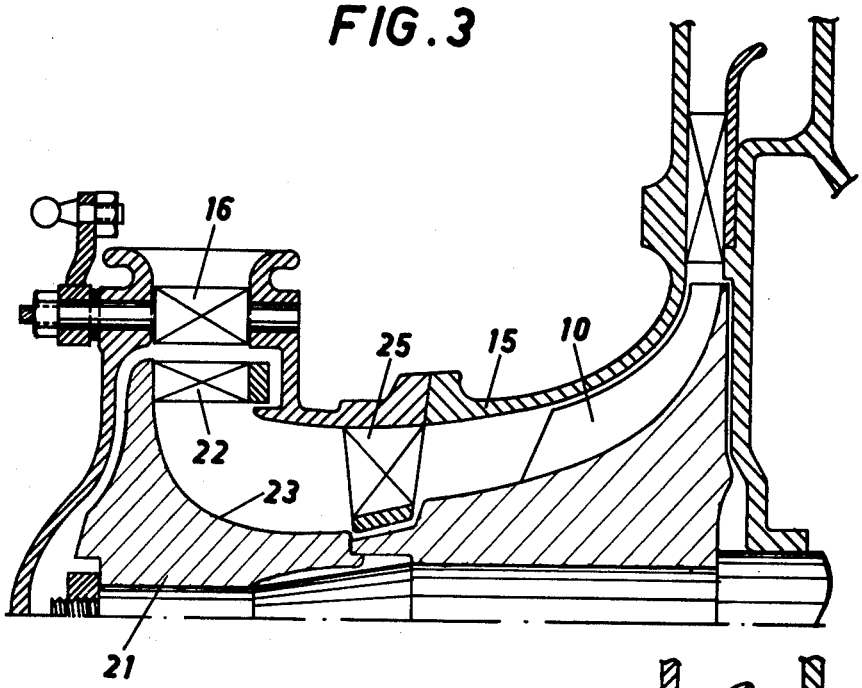
FIG. 3 is a section corresponding to that in FIG. 1 of a modified twostage compressor.

With the embodiment shown in FIG. 3 the plant also includes a centrifugal compressor 10 as the last stage. The centripetal compressor 21 is here designed in such a manner that its vanes 22 and the radially inward wall 23 of the outlet part are formed in its rotor. Hereby it will be easier to reduce the inlet diameter of the centripetal compressor, so it on occasion may be about the same as the outer inlet diameter of the centrifugal compressor.

The front end of shaft 11 carries the centripetal compressor stage 21, which is preceeded by inlet guide vanes 16. When the inlet vanes 16 are closed to a high degree the air will rotate substantially in the same direction as the rotor vanes and no compression at all will be obtained in the centripetal stage. This means a reduction of the air weight without the usual throttling losses. If the rotation in the same direction is increased this stage will cease to operate as a compressor and will start to work as a centripetal turbine. This feature is expecially attractive with gas turbines where rapid changes in the power output is desired with small or no changes in the rotational speed.

Figure 4:
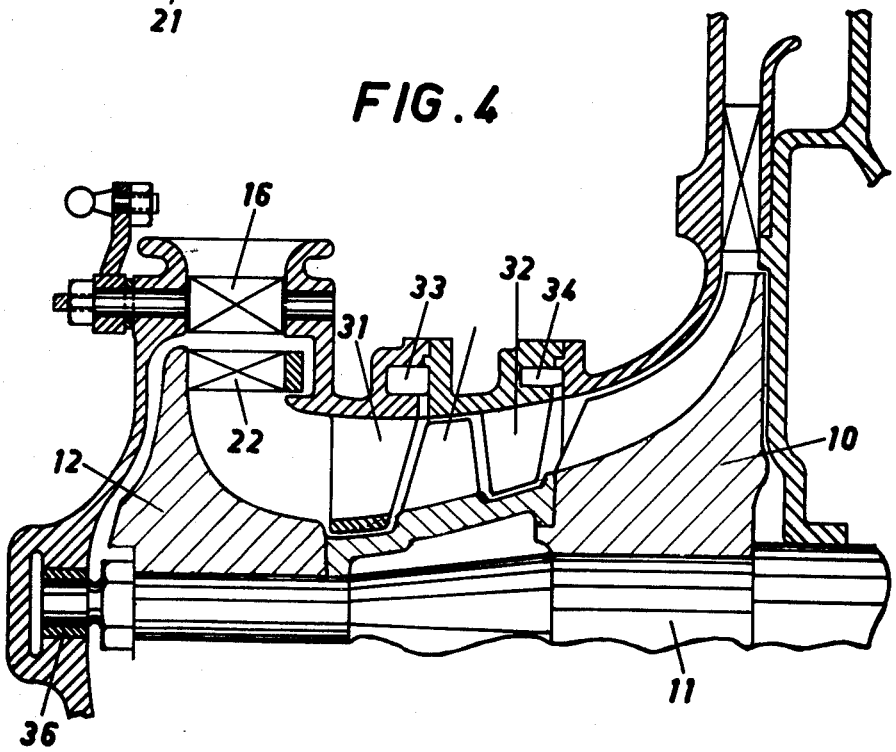
FIG. 4 shows a corresponding section through a threestage compressor.

The end of the shaft is carried by a front supporting, or dampening journal 36, (FIG. 4) which preferably is designed for air lubrication and then is connected to the high or the intermediate stage of the compressor.

In all embodiments shown the rotor diameter of the centripetal compressor does not exceed the outlet of the centrifugal compressor, which is advantageous with respect to the Mach-number and to the strength and will provide fine flow properties, a higher efficiency and a wide field of operation.

When the demand upon the compression ratio is not too high and the required field of operations is not especially broad the centrifugal stage may be designed with fixed inlet guide vanes, or possibly completely without such vanes.

When designing the centripetal compressor, and selecting the material therefore, the questions about costs, moment of inertia, maximum rotating speed and strength will be deciding. In order to obtain the highest stregth the vane ring should be provided with self a supporting end annuli carried by flexible membrane 13*a*.

This may for instance be slotted according to different patterns in order to obtain the desired flexibility and may be attached to the rotor disc for instance by electron beam welding. When used at high rotational speed the supporting annuli may be manufactured by composite material with baked in fibres or other reinforcing members. When a low moment of inertia is required the vane ring, and possibly also the rotor disc is made of light metal, titanium, carbon fibres, glass fibres, ceramic material or the like and is surface treated in order to reduce wear by contaminmants in the air.

What I claim is:

1. A multi-stage compressor including a first rotor having a peripheral inlet and a central outlet;

a second rotor having a central, annular inlet and a peripheral outlet;

a common shaft mounting said first and second rotors;

third rotor of the axial flow type having a hub portion fitted upon said common shaft, between said first and second rotors; and a housing enclosing said first, second and third rotors, and forming, together with said rotors, a passage-way for the fluid to be compressed, said passage being defined outwardly by said housing and inwardly by said rotors, said passage-way comprising means permitting flow substantially radially inwards past said first rotor, and substantially radially outwards past said second rotor.

2. The compressor according to claim 1 further including fixed vanes in said passage-way located upstream and downstream of said third rotor, said vanes being directed radially inwards from said housing.

3. The compressor according to claim 2 in which the fluid passage-way past said third rotor includes an annular portion defined by an outer wall forming part of said housing and having a substantially constant diameter, and by an inner wall formed by the hub of said third rotor, the diametrical dimension of said inner wall increasing in the direction of fluid flow.

4. A two stage compressor including a first rotor having a peripheral inlet and a central outlet;

a second rotor having a central, annular inlet and a peripheral outlet;

a common shaft mounting said first and second rotors, said first rotor carrying at its periphery, axially directed, cantilever vanes, the diameter at the peripheral inlet to said vanes being smaller than the mean value between the diameter at the peripheral outlet and of the outer diameter of said annular inlet of said second rotor;

a housing enclosing said first and said second rotors, said housing forming together with said rotors a passage-way for the fluid to be compressed, said passage being defined outwardly by said housing and inwardly by said rotors, said passage-way comprising means permitting flow substantially radially inwards past said first rotor, and substantially radially outwards past said second rotor; and fixed guide vanes in said passage-way, said guide vanes being located between said first and said second rotors, and being directed radially inwards from said housing.

* * * * *